US008348871B2

(12) United States Patent
Elliott et al.

(10) Patent No.: US 8,348,871 B2
(45) Date of Patent: Jan. 8, 2013

(54) APPARATUS FOR DRY HYDRO-THERAPY BODY MASSAGE OF A USER IN A SEATED POSITION

(75) Inventors: Timothy S. Elliott, Pinellas Park, FL (US); Paul J. Lunter, Palm Harbor, FL (US)

(73) Assignee: JTL Enterprises Inc., Clearwater, FL (US)

( * ) Notice: Subject to any disclaimer, the term of this patent is extended or adjusted under 35 U.S.C. 154(b) by 1246 days.

(21) Appl. No.: 12/157,505

(22) Filed: Jun. 11, 2008

(65) Prior Publication Data

US 2009/0312679 A1 Dec. 17, 2009

(51) Int. Cl.
*A61H 7/00* (2006.01)

(52) U.S. Cl. ..... 601/148; 601/155; 601/156

(58) Field of Classification Search ..... 601/55, 601/148, 155–160, 166–169
See application file for complete search history.

(56) References Cited

U.S. PATENT DOCUMENTS

| | | | | |
|---|---|---|---|---|
| 4,635,620 | A | 1/1987 | Ricchio | 128/64 |
| 4,751,919 | A | 6/1988 | Thomsen | 128/66 |
| 4,757,808 | A | 7/1988 | Effler, Jr. | 128/66 |
| 4,908,016 | A | 3/1990 | Thomsen | 128/66 |
| 4,976,256 | A | 12/1990 | Marlin et al. | 128/64 |
| 5,074,286 | A | 12/1991 | Gillaspie et al. | 128/33 |
| 5,713,834 | A | 2/1998 | Palmer | 601/149 |
| 5,827,206 | A * | 10/1998 | Lunter | 601/148 |
| 6,036,663 | A | 3/2000 | Arzt | 601/156 |
| 2007/0100261 | A1 * | 5/2007 | Turell et al. | 601/55 |
| 2008/0039750 | A1 * | 2/2008 | Mahmoud | 601/55 |

FOREIGN PATENT DOCUMENTS

| | | | |
|---|---|---|---|
| EP | 0 880 958 | A1 | 12/1998 |
| JP | 06319775 | A | 11/1994 |
| WO | WO 95/28904 | A1 | 11/1995 |

OTHER PUBLICATIONS

Supplementary European Search Report, dated Oct. 25, 2011.

* cited by examiner

*Primary Examiner* — Michael A. Brown
(74) *Attorney, Agent, or Firm* — K&L Gates LLP

(57) ABSTRACT

An apparatus for dry hydro-therapy body massage of a user in a seated position includes a housing structure having a user support surface wherein an upper body portion and a lower body portion of a user are supported in relative angular relation, and a fluid spray arrangement interiorly within the housing structure for directing a fluid stream at the user support surface for imparting a massaging effect through the support surface to the upper body portion and lower body portion of the user. The fluid spray arrangement is movable for travel along the user support surface in a first path of travel generally along the upper body portion of the user and a second path of travel angularly relative to the first path of travel generally along the lower body portion of the user.

17 Claims, 5 Drawing Sheets

APPARATUS FOR DRY HYDRO-THERAPY BODY MASSAGE OF A USER IN A SEATED POSITION

BACKGROUND OF THE INVENTION

The present invention relates generally to apparatus for applying a massaging effect to the body of a user and, more particularly, to dry hydro-therapy body massage apparatus utilizing a fluid spray arrangement for massage effect.

Massage is a time-honored and generally effective therapy for muscular injuries, strains and general soreness but, although massage is still recommended by many physicians for such purposes, this therapy has severely limited availability due to a scarcity of trained, qualified masseurs. As a result, many devices and apparatus have been proposed in the past for producing a massage-like manipulation of a user's body by various means, ranging from mechanically or electrically-generated vibrations or pulsations, usually accompanied by heating, to pulsations of pressurized water, applied either is a wet environment such as partially submerging the user's body in a bath device or in a dry environment wherein a fluid spray arrangement is housed in a fluid-tight bed or chair type structure for applying a massaging effect to the user's body without requiring the user to disrobe.

Representative examples of the latter form of apparatus, often commonly referred to as dry hydro-therapy massage, are disclosed in U.S. Pat. Nos. 4,635,620; 4,751,919; 4,757,808; 4,908,016; 4,976,256; 5,074,286; 5,713,834; 5,827,206; and 6,036,663. Such apparatus have met with moderate success, and efforts continue within the relevant industry to expand their acceptance, availability and usefulness.

The majority of such known hydro-therapy massage apparatus are in the form of a bed-type structure having an essentially horizontal user support surface on which the user may lay in a recumbent position. Advantageously, the horizontally recumbent position of the user's body in such bed type structures enables the massaging fluid spray to be applied via a manifold device arranged for lengthwise travel within the interior of the apparatus in an essentially linear path of travel alongside the body of a user, allowing the entire length or any portion of the user's body to be treated by the hydro-therapy massage.

On the other hand, one of the perceived disadvantages of a bed-type dry hydro-therapy apparatus is that the recumbent disposition of the user is not conducive to enabling the user to engage in other activities during the operation of the apparatus, e.g., reading, watching television, operation of a laptop computer or other personal electronic device, etc. For such reasons, a desire has been expressed in the industry for a dry hydro-therapy massage apparatus wherein the user may rest in a generally seated disposition during operation of the apparatus, allowing the user to read a book or magazine, watch television, and remain otherwise occupied with other activities.

One apparatus to address this need is disclosed in U.S. Pat. No. 5,827,206, which discloses a chair for performing dry hydro-massage on a user in a seated position. While this chair apparatus has met with a reasonable degree of success, a limitation of the apparatus is that a linearly traveling spray manifold arrangement as used in bed-type apparatus is not adaptable to accommodate massaging of the relative angular disposition of the user's upper body and lower body when in a seated position on the apparatus. Instead, this apparatus utilizes a series of fixed spray heads or jets arranged to massage only the upper body of the user. Thus, the apparatus is not capable of performing a full length body massage on a seated user.

SUMMARY OF THE INVENTION

It is accordingly an object of the present invention to provide an apparatus for dry hydro-therapy body massage of a user in a seated disposition which overcomes the above-described disadvantages of known apparatus. It is another object of the present invention to provide such a massage apparatus with a traveling fluid spray arrangement that is capable of following angular paths of movement in conformity to the disposition of a user's body in a seated disposition.

As used herein, the phrase "seated" position or disposition is intended to mean any orientation of a user's body wherein the upper body is oriented in an angular relation to the lower body, including for example but without limitation an upright disposition in which the user's torso is essentially or predominantly vertical while the user's hips and upper legs (thighs) are generally or predominantly horizontal, or a reclined disposition in which the user's torso is rearwardly inclined from vertical and the user's hips and upper legs are forwardly inclined from vertical, and various degrees of other seated dispositions intermediate such positions. In any such seated disposition, the user's lower body may be oriented with the knees bent to at least a partial extent such that the upper and lower legs are also angled relative to the other, or with the knees essentially unbent such that the upper and lower legs are generally aligned.

Briefly summarized, the present invention provides an apparatus for dry hydro-therapy body massage of a user in a seated position, basically comprising a housing structure having a user support surface for supporting a user in a seated position wherein an upper body portion and a lower body portion of a user are supported in relative angular relation, and a fluid spray arrangement interiorly within the housing structure for directing a fluid stream at the user support surface for imparting a massaging effect through the support surface to the upper body portion and lower body portion of the user. According to the present invention, the fluid spray arrangement is movable for travel along the user support surface in a first path of travel generally along the upper body portion of the user and a second path of travel angularly relative to the first path of travel generally along the lower body portion of the user.

Various embodiments of the present invention are contemplated. In a preferred embodiment, the dry hydro-therapy body massage apparatus has the user support surface configured to support the lower body portion of the user with an upper leg extent thereof in relative angular relation to a lower leg extent thereof. Alternatively, the present apparatus may have the user support surface configured for a more upright disposition of the user similar to that of U.S. Pat. No. 5,827,206 or a predominantly upright disposition of the user.

A guide arrangement is preferably provided for directing movement of the fluid spray arrangement along the first and second paths. A drive arrangement is also provided for imparting movement to the spray arrangement along the guide arrangement.

The guide arrangement preferably comprises a guide track having a first guide section extending along the first path and a second guide section extending along the second path. Guide rollers may be provided on the fluid spray arrangement in following engagement with the guide sections of the guide track. A plurality of guide pulleys may be arranged at spacings along the guide track and a guide belt connected to the spray arrangement and extending therefrom in engagement with the guide pulleys. The drive arrangement is preferably connected to one of the guide pulleys for imparting movement to the spray arrangement along the guide arrangement.

The housing structure of the present invention may preferably be configured in the form of a chair body for supporting the user in a seated position. The chair body may have a seat portion for supporting the lower body portion of the user and a seat back portion for supporting the upper body portion of the user. More preferably, the seat portion of the chair body may include a main seat section adapted to support the upper leg extent of the lower body portion of the user and an ottoman section in relative angular relation to the main seat section adapted to support a lower leg extent of the lower body portion of the user in relative angular relation to the upper leg extent.

The chair body may define an elongate opening disposed along the seat back and seat portions, with the user support surface attached to said chair body in covering relation with the opening. The user support surface may preferably comprise a flexible membrane adapted for transmission therethrough of a massaging effect by the fluid stream to the user. It is further preferred that the user support surface comprises a net disposed adjacent the membrane for weight-bearing support of the user.

A fluid reservoir may be provided within the chair body or otherwise in fluid communication with the chair body. A circulation system is also preferably provided for circulating fluid between the reservoir and the fluid spray arrangement.

DETAILED DESCRIPTION OF THE PREFERRED EMBODIMENT

As will be readily understood by persons skilled in the relevant art, the dry hydro-therapy apparatus of the present invention is readily adapted to be embodied in many and various forms to accommodate massage of a user in differing seated positions. The present invention is described herein in one contemplated embodiment of such apparatus, but only for purposes of providing an exemplary enabling disclosure of the invention and, in particular, the invention is not intended to be limited, and should not be construed as limited, to application or embodiment in such apparatus nor any other particular structure except as defined in the claims appended hereto.

Figure 1:
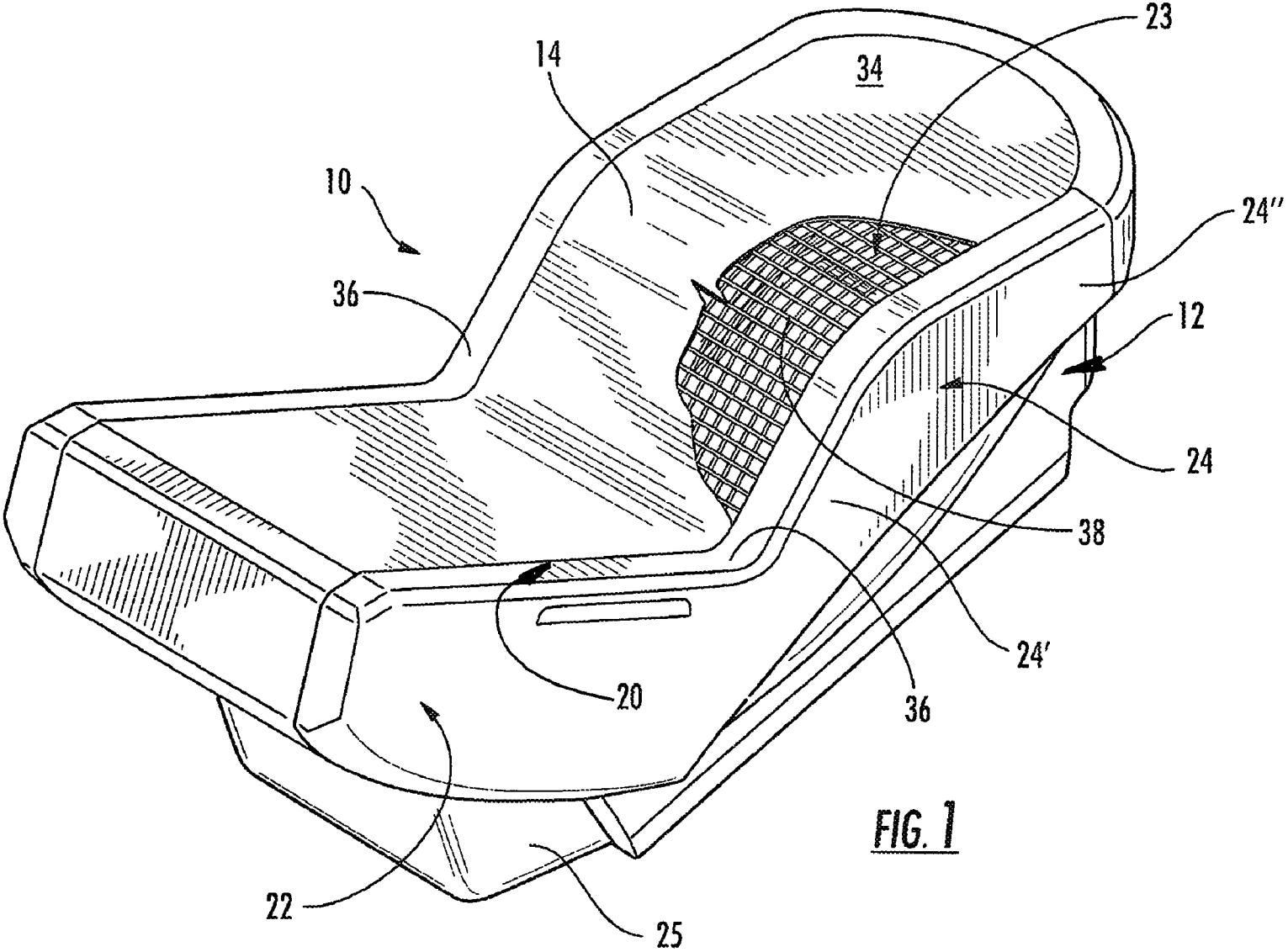
FIG. 1 is a perspective view of an apparatus for dry hydro-therapy massage of a user in a seated position according to a preferred embodiment of the present invention.
Figure 2:
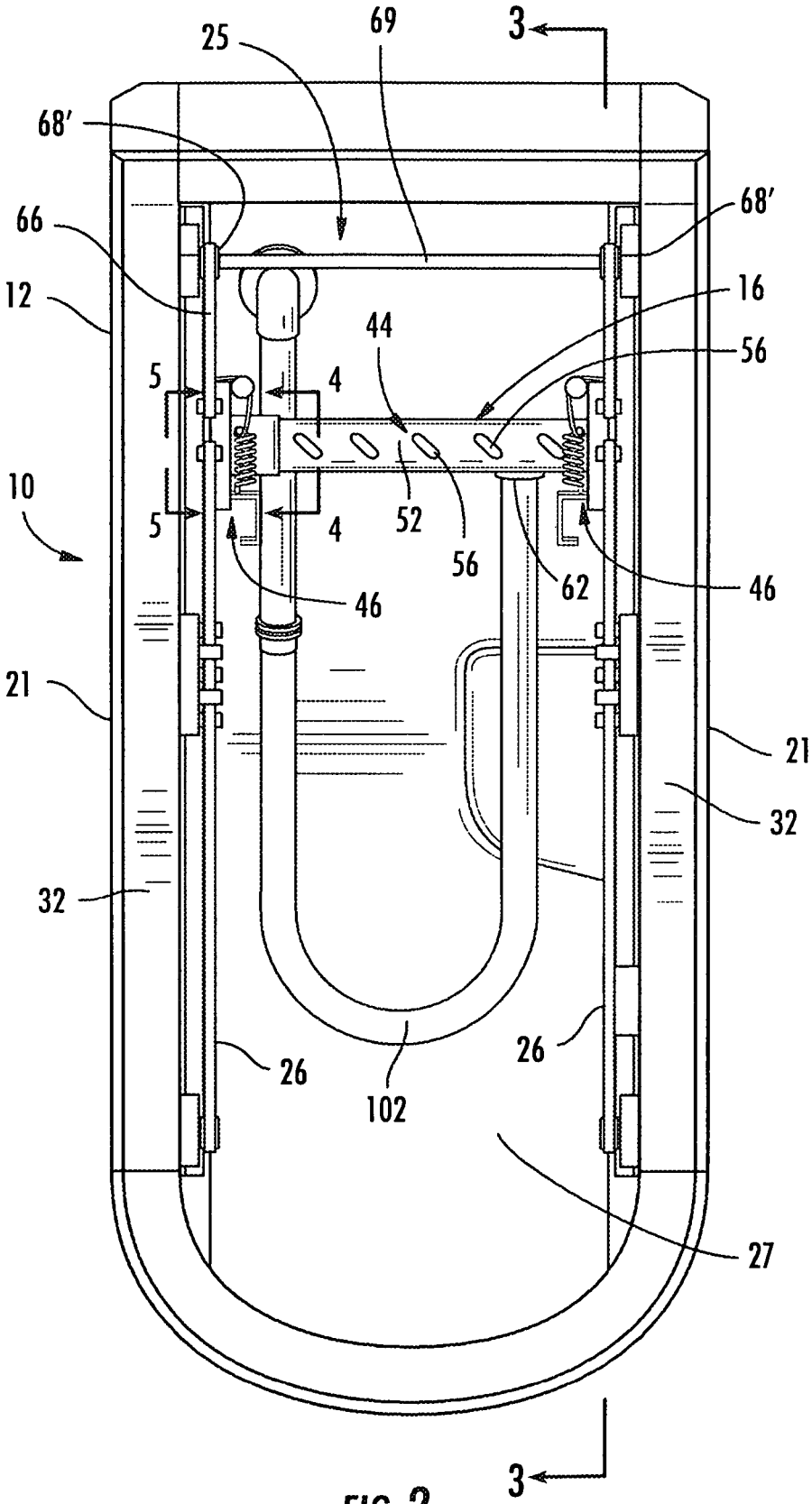
FIG. 2 is a top plan view of the dry hydro-therapy massage apparatus of FIG. 1 with the user support surface removed for clarity of the internal operational components of the apparatus.
Figure 3:
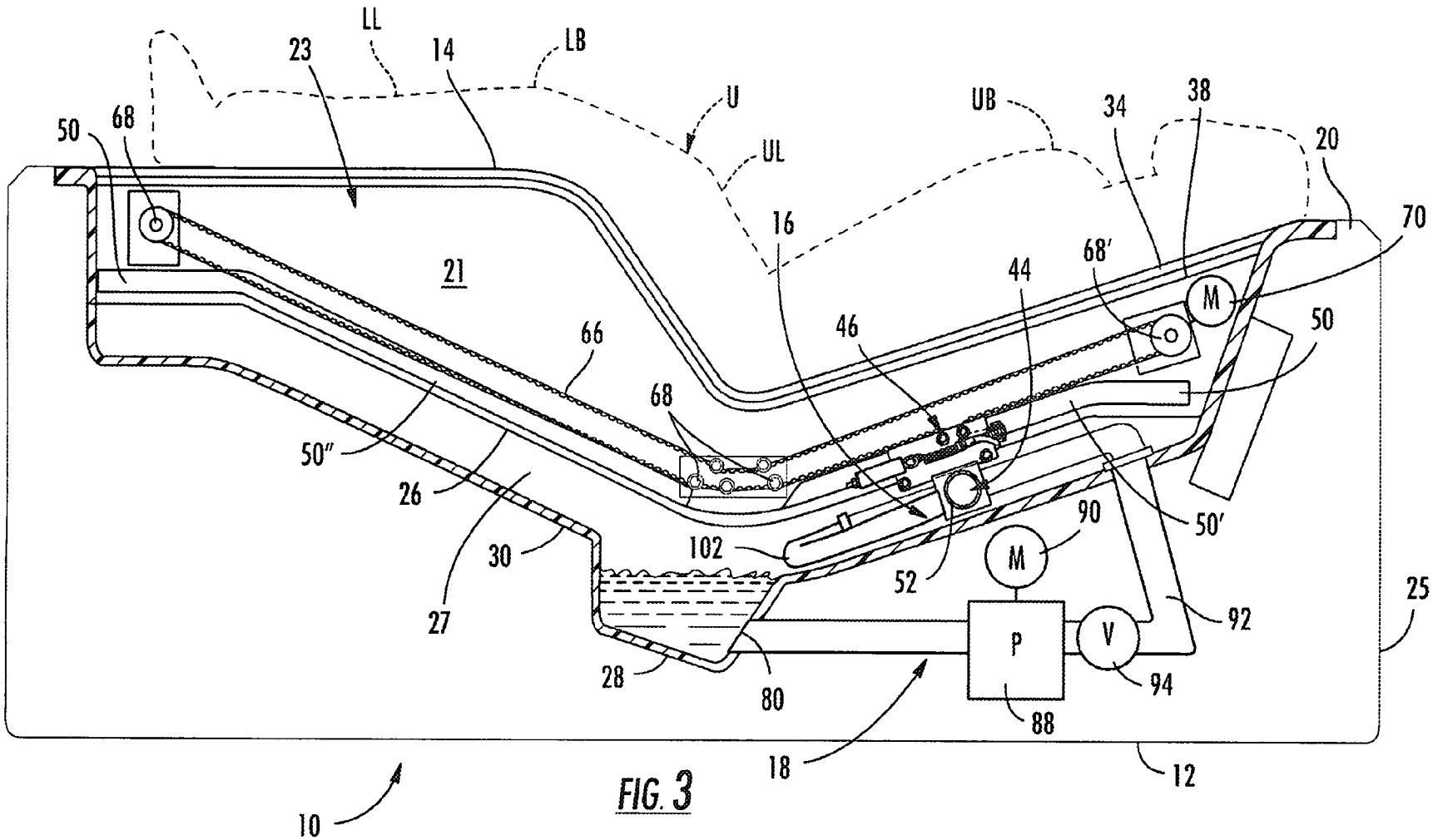
FIG. 3 is a vertical cross-sectional view of the dry hydro-therapy massage apparatus for of FIGS. 1 and 2 taken along line 3-3 of FIG. 2.

Referring now to the accompanying drawings and initially to FIGS. 1-3, a dry hydro-therapy body massage apparatus according to one contemplated preferred embodiment of the present invention is generally indicated at 10. The body massage apparatus 10 includes a housing structure, generally indicated at 12, generally in the form of a lounge chair style structure, presenting an upwardly facing side 14 forming a user support surface configured for a user to rest thereon for massage treatment in a seated reclining position, as more fully explained hereinafter. A fluid spray arrangement, generally indicated at 16 (FIGS. 2 and 3), is disposed within the housing in association with a pressurized fluid supply arrangement, generally indicated at 18 (FIGS. 2 and 3), for directing a pressurized fluid emission at the underside of the user support surface 14 to transmit a massaging effect therethrough to the body of a user seated thereon.

The lounge chair structure 12 includes a chair body formed as a substantially hollow housing shell 20 generally in the form of a tank or tub of an elongated configuration closed at its bottom and side walls and substantially open at its top to define an upwardly-facing elongated opening 23. The housing shell 20 may be fabricated of any suitable watertight, rigid material of appropriate strength which may be formed to the desired configuration herein described, e.g., fiberglass, plastic, or a like material. The housing shell 20 is supported on a floor-standing frame 25, e.g., fabricated of any suitable structural material (metal bar stock, tubing, fiberglass or the like), to elevate and orient the user support surface 14 at a desired height and inclination above the floor while also providing an open area within the frame 25 and beneath the housing 20 for enclosure of various operating components of the body massage apparatus 10.

The lateral side walls 21 of the housing shell 20 are contoured to form a seat back portion 22 and a seat portion 24 angularly oriented relative to one another, with the seat portion 24 having a main seat section 24' and an ottoman section 24" also angularly oriented to one another, forming the user support surface 14 into a configuration by which the upper and lower body portions UB, LB, respectively, of the user U are supported in a generally reclining seated disposition comparable to that of a lounge style chair wherein the user's body rests bent at the waist and knees with the upper body portion partially reclined on the seat back portion 22, the upper leg extent UL of the lower body portion LB slightly inclined on the main seat section 24', and the lower leg extent LL generally horizontal or slightly declined on the ottoman section 24", all as depicted in FIG. 3.

A hollow interior chamber 27 is defined by the housing shell 20. The housing shell 20 provides opposing shelves 26 which project inwardly of the housing shell 20 from each opposite lengthwise side wall 21 of the housing shell 20 and which extend angularly therealong in general conformity to the angular orientation of the seat back and seat portions 22, 24. The bottom wall 30 of the housing shell 20 forms a drainage surface inclining into a reservoir basin 28 centrally along the lengthwise extent of the housing shell 20. The uppermost extent of the housing shell 20 forms a flange surface 32 for mounting thereto of the user support surface 14.

A liquid material is preferred as the fluid medium utilized by the body massage apparatus 10 for supply to and emission from the fluid spray arrangement 16 to produce a massage effect as hereinafter described, water being an optimal liquid in view of its ready availability and generally non-corrosive and non-caustic character. A suitable supply of water, or another appropriate liquid, is stored in the reservoir basin 28 for continuous circulation through the fluid supply arrangement 18 and the fluid spray arrangement 16, the shelf 26 and the bottom drainage wall 30 as well as the other interior surfaces of the housing shell 20 being configured to drain the liquid emitted from the fluid spray arrangement 16 into the basin 28. Of course, as those persons skilled in the art will readily recognize, pressurized air, other gases, and other fluidic materials could also be utilized as the fluid massaging medium without departing from the scope and substance of the present invention and, accordingly, the present invention is not intended to be and should not be construed as limited to the use of water or another liquid massage medium.

It is also preferred that the water or other massage liquid be heated to enhance the massaging effect produced by the liquid, e.g., to a temperature approximating normal body temperature, preferably in the range of 95 to 100 degrees Fahrenheit, although the apparatus has the capability of a broad range of liquid temperatures. For this purpose, a heater element (not shown) may be provided, e.g., mounted within the liquid reservoir basin 28 below the normal level of massage liquid therein to be substantially continuously submerged in the stored massage liquid. A thermostat (not shown) is preferably provided in the electrical circuit to the heating element to provide selective control of the temperature of the massage liquid. The apparatus may also be provided with a liquid cooling system if and to the extent necessary or desirable to offset heat gain to the massage liquid that may also occur from frictional contact of the liquid while being circulated through the apparatus.

The user support surface 14 may be formed of a relatively thin sheet 34 of a waterproof material affixed in watertight relation across the flange 32 bordering the upwardly facing opening 22. The sheet 34 preferably is sufficiently thin that the impact of fluid emitted from the fluid spray arrangement 16 against the underside of the sheet 34 transmits a massaging effect through the sheet 34 to the body of the user. Further, the sheet 34 is preferably of a sufficient flexibility and resiliency to substantially conform to the body of the user for maximum transmission of the massage effect through the sheet 34 to the user. In this manner, the sheet 34 functions in the nature of a waterproof membrane to keep the user dry during operation of the body massage apparatus 10 without noticeably dampening the massaging impact of fluid emitted from the fluid spray arrangement 16. For example, a latex rubber in sheet form, in the range of 40 to 55 mil. thickness, is a suitable material to provide these characteristics for the sheet 34, although various other commercially available rubber and plastic sheeting materials should also provide suitable results.

As a primary means of weight bearing support of the user, an open-mesh netting 38 may be affixed in tensioned condition to the flange 32 of the housing shell 20 horizontally across its opening 22 immediately beneath the sheet 34. The netting 38 should be of sufficient strength to independently support the weight of a user to provide a safety barrier in the event of a rupture or other failure of the sheet 34. At the same time, the open-mesh construction of the netting 38 permits essentially unrestricted transmission of fluid from the fluid spray arrangement 16 through the netting 38 and against the underside of the sheet 34.

As depicted in FIG. 1, the flange 32 as well as the side walls 21 of the housing shell 20 are covered by frame panels 36 to provide an aesthetically pleasing exterior enclosure of the overall housing shell 20 and the internal operational components housed beneath the shell 20. The upper surface of the frame panels 36 covering and bordering the flange 32 may preferably be cushioned for the comfort of the user in ingress and egress to and from the user support surface 14.

Other than the portion of the interior chamber 25 occupied by the water stored in the basin 28 and the area occupied by the fluid spray arrangement 16 and the fluid supply arrangement 18, the interior chamber 25 of the housing shell 20 is substantially filled with air. As desired, the interior chamber 25 may be slightly pressurized during operation, e.g., by a fan (not shown) or the like communicated with the interior of the chamber 25 to slightly inflate the sheet 34 to enhance the feeling of support to a user laying on the sheet 34 and the netting 38 and at the same time to maximize conformity of the sheet 34 to the body of the user.

The fluid spray arrangement 16 includes an elongate massage head, generally indicated at 44, oriented transversely across substantially the full widthwise extent of the chamber 25. The massage head 44 may be of any of various possible configurations and componentry adapted to emit the massage fluid under pressure against the underside of the membrane sheet 34. For example, in one possible configuration, the massage head 44 may have a substantially hollow outer body 52 with a plurality of emission openings each fitted with a venturi-type tubular jet nozzle 56 over substantially the full extent of the upward surface of the body 52 which faces the sheet 34 for causing pressurized fluid delivered into the body 52 to be emitted in a jet-like spray upwardly from the nozzles 56 against the underside of the membrane sheet 34.

Figure 4:
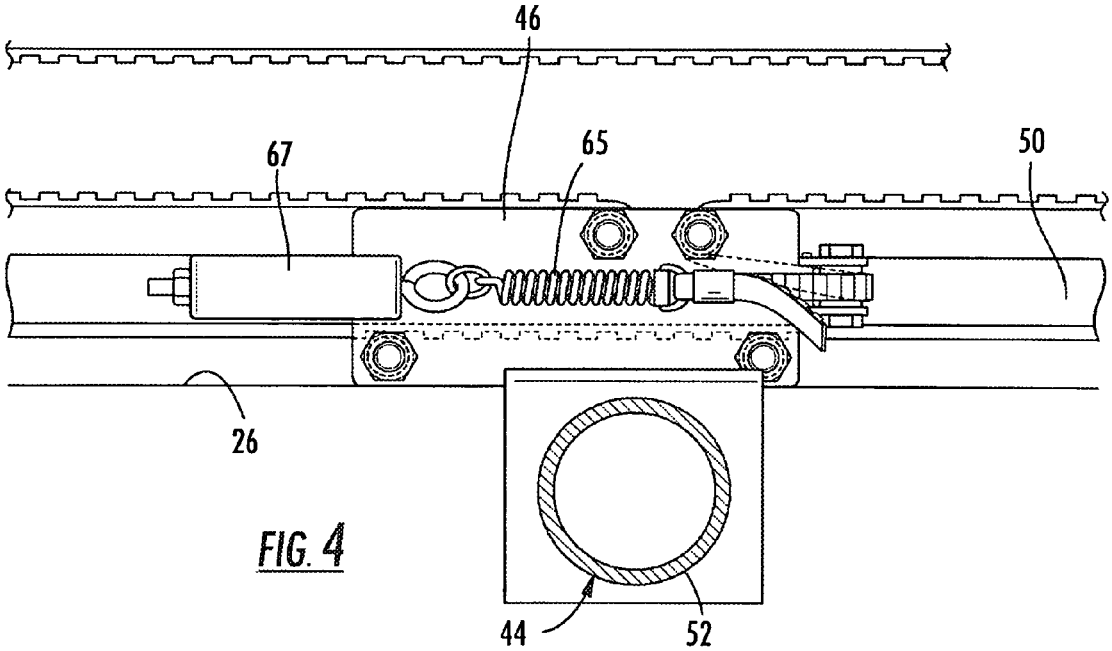
FIG. 4 is an enlarged elevational view of the guide arrangement for the fluid spray arrangement of the dry hydro-therapy massage apparatus of FIGS. 1 and 2, taken along line 4-4 of FIG. 2.
Figure 5:
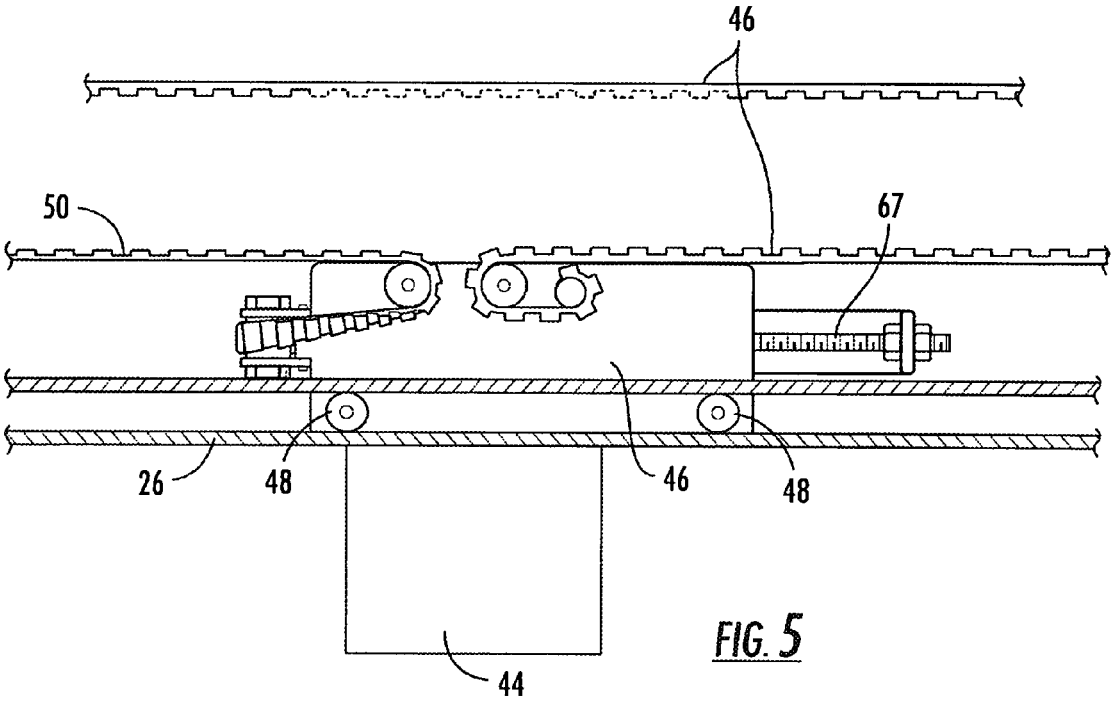
FIG. 5 is another elevational view of the side of the guide arrangement of the dry hydro-therapy massage apparatus of FIGS. 1 and 2, taken along line 5-5 of FIG. 2 showing the side thereof opposite that of FIG. 4.

As best seen in FIGS. 3-5, the elongate massage head 44 is supported at each opposite end by brackets 46 on rollers or wheels 48 (FIG. 5) for rolling travel along the shelves 26 traversingly back-and-forth through substantially the full lengthwise extent of the chamber 25 along angularly changing paths of travel following the angular configuration of the shelves 26. A pair of angular tracks 50 are affixed interiorly to the side walls 21 of the housing shell 20 immediately above the shelves 26, respectively, each extending in angular sections 50', 50" following the angular configuration of the shelves 26 in parallel spaced relation thereto through substantially the full lengthwise extent of the chamber 25 to contain the rollers 48 between the tracks 50 and the shelves 26 during lengthwise traversing travel within the chamber 25.

The traversing travel of the massage head 44 is driven reciprocally back-and-forth through the lengthwise extent of the massage chamber 25 via any suitable drive mechanism. For, example, in the illustrated embodiment, a toothed timing belt 66 is attached at opposite belt ends to each respective bracket 46 at the ends of the massage head 44, forming two endless drive belt loops which are trained about a series of toothed guide pulleys 68 rotatably mounted to the interior surfaces of the side walls 21 adjacent the tracks 50 at each opposite end of the chamber 25 and also at the location of each change of angular direction in the shelves 26 and the tracks 50. The pulleys 68' at one end of the chamber 25 are secured to a common drive shaft 69 journaled through one side wall 21 and connected exteriorly thereof to a reversible drive motor 70 for imparting synchronous drive motion to the belts 66 and, in turn, to the massage head 44 to travel along the shelves 26 and the tracks 50. Any suitable form of sensors, such as electric eyes (not shown), may be provided at the limits of the massage head travel to control reversal of the drive motor 70.

Depending upon the degree of angular changes in direction of travel imposed on the massage head 44, elongational forces may be imposed on the drive belts 66 as the massage head 44 travels about the pulleys 68 at the location of directional changes. These and any similar such forces acting on the belts 66 may be accommodated by attaching one end of each belt 66 to its respective bracket 46 via a biasing spring 65 adjustable by a turnbuckle 67 to allow a limited degree of elongation and contraction of the belts 66 to mitigate any risk of damage to the belts 66.

Pressurized fluid is delivered from the fluid supply arrangement 18 to the massage head 44 in any suitable way. For example, the pressurized fluid supply arrangement 18 may have an electric motor 90 driving a liquid pump 88 to draw fluid from the liquid reservoir basin 28 of the housing shell 20, e.g., via a submerged tubular fitting 80. The outlet side of the pump 88 delivers the fluid under pressure to the massage head 44 through a conduit 92 with a flow control valve 94 disposed therein and a length of flexible tubing 102 connected between the conduit 92 and a fitting 62 on the outer body 52 of the massage head 44.

The operation of the body massage apparatus of the present invention may thus be understood. As the massage head 44 travels back-and-forth lengthwise within the chamber 25, the pressurized liquid is delivered from the pump 88 through the intervening conduits into the interior of the outer body 52 of the massage head 44 and in jet-like spray therefrom through the emission nozzles 56. The relative thinness of the sheet 34 together with its resilient flexibility causes the sheet 34 to conform relatively closely to the shape and contours of the user's body and, in turn, the impact of the jetted liquid against the underside of the sheet 34 is readily transmitted therethrough to the body of the user to produce a massaging effect on the user's body. As the massage head 44 reaches each opposite end of the interior chamber 25 in its traveling movement, the electric eyes or other sensors recognize the presence of the massage head 44 and, in turn, actuate reversal of the electric motor 70 to initiate driving of the massage head 44 in the opposite direction.

In contrast to any other known dry hydro-therapy massage apparatus, the massage head 44 in the present apparatus uniquely changes angular direction in following relation to the shelves 26 and the tracks 50 during each traversal through the chamber 25, between at least a first path of linear travel along the seat back portion 22 of the apparatus and a second angularly oriented path of linear travel along the main seat section 24' and the ottoman section 24" of the seat portion 24 of the apparatus. Optionally, the shelves 26 and the tracks 50 may be configured to define additional angular changes in the path of linear travel of the massage head 44, e.g., as seen in FIG. 3 wherein the massage head 44 transitions into relatively shorter third and fourth angular paths of travel at the terminal ends of its overall travel. In this manner, the massage head 44 is being enabled to travel back-and-forth the full length of the interior chamber 25 to apply a massaging effect over the user's entire body. Owing to the unique ability of the drive arrangement for the massage head to change angular directions of travel in conformity to the angular orientation of the user's body as reclined on the user support surface 14, the massage effect is substantially uniform throughout the entire path of travel and on all portions of the user's body.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. Apparatus for dry hydro-therapy body massage of a user in a seated position, comprising:

a housing structure having a user support surface for supporting a user in a seated position wherein an upper body portion and a lower body portion of a user are supported in relative angular relation, and a fluid spray arrangement interiorly within the housing structure for directing a fluid stream at the user support surface for imparting a massaging effect through the support surface to the upper body portion and lower body portion of the user, the fluid spray arrangement being movable for travel along the user support surface in a first path of travel generally along the upper body portion of the user and a second path of travel along an acute angle relative to the first path of travel generally along the lower body portion of the user.

2. Apparatus for dry hydro-therapy body massage of a user in a seated position according to claim 1, wherein the user support surface is adapted to support the lower body portion of the user with an upper leg extent thereof in relative angular relation to a lower leg extent thereof.

3. Apparatus for dry hydro-therapy body massage of a user in a seated position according to claim 1, further comprising a guide arrangement for directing movement of the fluid spray arrangement along the first and second paths.

4. Apparatus for dry hydro-therapy body massage of a user in a seated position according to claim 3, further comprising a drive arrangement for imparting movement to the spray arrangement along the guide arrangement.

5. Apparatus for dry hydro-therapy body massage of a user in a seated position according to claim 3, wherein the guide arrangement comprises a guide track having a first guide section extending along the first path and a second guide section extending along the second path.

6. Apparatus for dry hydro-therapy body massage of a user in a seated position according to claim 5, wherein the guide arrangement comprises guide rollers on the fluid spray arrangement in following engagement with the guide sections of the guide track.

7. Apparatus for dry hydro-therapy body massage of a user in a seated position according to claim 6, wherein the guide arrangement comprises a plurality of guide pulleys arranged at spacings along the guide track and a guide belt connected to the spray arrangement and extending therefrom in engagement with the guide pulleys.

8. Apparatus for dry hydro-therapy body massage of a user in a seated position according to claim 7, further comprising a drive arrangement connected to one of the guide pulleys for imparting movement to the spray arrangement along the guide arrangement.

9. A chair for dry hydro-therapy body massage of a user in a seated position, comprising:

a chair body for supporting a user in a seated position, the chair body having a seat portion for supporting a lower body portion of a user and a seat back portion for supporting an upper body portion of the user, the chair body defining an elongate opening disposed along the seat back and the seat portions;

a user support surface attached to said chair body in covering relation with said opening;

a fluid reservoir in fluid communication with said chair body;

a fluid spray arrangement interiorly within the chair body for directing a fluid stream at the user support surface for imparting a massaging effect through the support surface to the upper body and lower body portions of the user;

a circulation system for circulating fluid between the reservoir and the fluid spray arrangement; and a guide arrangement for directing movement of the fluid spray arrangement for travel along the user support surface in a first path of travel generally along at least a partial extent of the seat back portion adjacent the upper body portion of the user and a second path of travel along an acute angle relative to the first path of travel generally along at least a partial extent of the seat portion adjacent the lower body portion of the user.

10. A chair for dry hydro-therapy body massage of a user in a seated position according to claim 9, wherein the user support surface comprises a flexible membrane adapted for transmission therethrough of a massaging effect by the fluid stream to the user.

11. A chair for dry hydro-therapy body massage of a user in a seated position according to claim 10, wherein the user support surface comprises a net disposed adjacent the membrane for weight-bearing support of the user.

12. A chair for dry hydro-therapy body massage of a user in a seated position according to claim 9, wherein the seat portion of the chair body includes a main seat section adapted to support an upper leg extent of the lower body portion of the user and an ottoman section in relative angular relation to the main seat section adapted to support a lower leg extent of the lower body portion of the user in relative angular relation to the upper leg extent.

13. A chair for dry hydro-therapy body massage of a user in a seated position according to claim 9, further comprising a drive arrangement for imparting movement to the spray arrangement along the guide arrangement.

14. A chair for dry hydro-therapy body massage of a user in a seated position according to claim 9, wherein the guide arrangement comprises a guide track having a first guide section extending along the first path and a second guide section extending along the second path.

15. A chair for dry hydro-therapy body massage of a user in a seated position according to claim 14, wherein the guide arrangement comprises guide rollers on the fluid spray arrangement in following engagement with the guide sections of the guide track.

16. A chair for dry hydro-therapy body massage of a user in a seated position according to claim 15, wherein the guide arrangement comprises a plurality of guide pulleys arranged at spacings along the guide track and a guide belt connected to the spray arrangement and extending therefrom in engagement with the guide pulleys.

17. A chair for dry hydro-therapy body massage of a user in a seated position according to claim 9, further comprising a drive arrangement connected to one of the guide pulleys for imparting movement to the spray arrangement along the guide arrangement.

* * * * *